US006246170B1

(12) United States Patent
Sugawara

(10) Patent No.: US 6,246,170 B1
(45) Date of Patent: Jun. 12, 2001

(54) LIGHT SOURCE APPARATUS WITH A SPHERICAL OPTICAL MEMBER

(75) Inventor: Saburo Sugawara, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/190,288

(22) Filed: Nov. 13, 1998

(30) Foreign Application Priority Data

Nov. 18, 1997 (JP) ..... 9-333497

(51) Int. Cl.[7] ..... H01J 17/20

(52) U.S. Cl. ..... 313/570; 313/634; 313/635

(58) Field of Search ..... 313/570, 620, 313/621, 622, 625, 631, 113, 112, 634, 635, 491, 623, 624, 626, 25, 26; 362/255, 256

(56) References Cited

U.S. PATENT DOCUMENTS 5,258,691 * 11/1993 Dakin et al. ..... 313/620
5,587,626 * 12/1996 Parham et al. ..... 313/634

* cited by examiner

*Primary Examiner*—Nimeshkumar D. Patel
*Assistant Examiner*—Joseph Williams
(74) *Attorney, Agent, or Firm*—Fitzpatrick, Cella, Harper & Scinto

(57) ABSTRACT

A light source apparatus includes a spherical optical member formed with a transparent material and having an outer wall and an inner wall, and a light emitting part having a light emission center located within a space surrounded with the inner wall of the optical member, wherein the light emission center deviates from at least one of a center of the outer wall and a center of the inner wall, and the optical member is arranged to deflect in a predetermined direction a light flux emitted from the light emission center to be led to a reflector, so that the efficiency of use of light can be enhanced.

23 Claims, 11 Drawing Sheets

LIGHT SOURCE APPARATUS WITH A SPHERICAL OPTICAL MEMBER

BACKGROUND OF THE INVENTION

1. Field of the Invention

The present invention relates to a light emitting tube and a light source apparatus using the same, which are arranged to efficiently use a light flux emitted from a light emitting part and to be suited to illumination apparatuses or projection apparatuses such as a liquid crystal projector, an overhead projector and the like.

2. Description of Related Art

A light emitting tube, such as a metal-halide lamp or a high-pressure mercury lamp, has heretofore been used for the light source apparatuses such as a liquid crystal projector.

FIG. 16 schematically shows the essential parts of a light emitting tube used for a conventional liquid crystal projector. In FIG. 16, reference numeral 210 denotes the light emitting tube. Two arc bars 202 are disposed in the light emitting tube 210. A middle point of a space between the two arc bars 202 is a light emission center 202*a*. The light emitting tube 210 is provided with a spherical body part 210*a*. The spherical body part 210*a* has an outer wall 210*d* and an inner wall 210*b*. The light emission center 202*a* is made to be located at a sphere center 210*c* of the outer wall 210*d* of the spherical body part 210*a*.

Referring to FIG. 16, a light flux radiating from the light emission center 202*a* exits through the inner wall 210*b* from the spherical body part 210*a*. In this instance, the distribution angle of luminous intensity of the light flux exiting from the light emitting tube 210 is wide and has a luminous intensity distribution which is symmetrical at about 50 degrees with respect to a line perpendicular to the longitudinal direction of the light emitting tube 210 indicated by an double-headed arrow 203, as shown in FIG. 16.

In a case where the light emitting tube 210 having a symmetrical light intensity distribution characteristic as shown in FIG. 16 is used in combination, for example, with an ellipsoidal mirror 211 which is employed as a light-condensing reflecting mirror, the ellipsoidal mirror 211 must be in such a shape that it has a small first focal point F1, as shown in FIG. 17, in order to use as much as possible the light emitted from the light emitting tube 210. As a result, the ellipsoidal mirror 211 comes to have a large image-forming magnifying rate. However, in a case where an aperture provided for incidence of an illumination light is small and thus necessitates a small light source image, the large image-magnifying rate of the ellipsoidal mirror 211 makes it difficult to enhance the efficiency of illumination.

In particular, rays of light radiating at angles more than 50 degrees with respect to a line perpendicular to the longitudinal direction of the light emitting tube 210 are repeatedly total-reflected by the inner wall surface of the light emitting tube 210 to be caused to exit from the end face of the light emitting tube 210. In other words, rays of light radiating at angles more than 50 degrees with respect to a line perpendicular to the longitudinal direction of the light emitting tube 210 fail to be projected on the reflection surface of the ellipsoidal mirror 211 and thus become wasteful light.

Further, in a case where the light emitting tube 210 having a symmetrical light intensity distribution characteristic as shown in FIG. 16 is used in combination, for example, with a paraboloidal mirror 212 which is employed as a light-condensing reflecting mirror, the paraboloidal mirror 212 must be in such a shape that has a short focal point F, as shown in FIG. 18, in order to use as much as possible the light emitted from the light emitting tube 210. Such an arrangement, however, causes rays of light reflected by the paraboloidal mirror 212 to have an inadequate degree of parallelism.

The degree of parallelism of the exiting light flux greatly degrades particularly at a part of the reflection surface of the paraboloidal mirror 212 in the neighborhood of the optical axis A, because the angle subtended by the light emission center 202*a* is large. Besides, like in the case of the ellipsoidal mirror shown in FIG. 17, rays of light radiating at angles more than 50 degrees with respect to a line perpendicular to the longitudinal direction of the light emitting tube 210 are repeatedly total-reflected by the inner wall surface of the light emitting tube 210 and eventually exit from the end face of the light emitting tube 210. In other words, rays of light radiating at angles more than 50 degrees with respect to a line perpendicular to the longitudinal direction of the light emitting tube 210 fail to be projected on the reflection surface of the paraboloidal mirror 212 and thus become wasteful light.

BRIEF SUMMARY OF THE INVENTION

The invention is directed to the solution of the problems of the prior art described in the foregoing. It is, therefore, an object of the invention to provide a light emitting tube and a light source apparatus using the same, wherein the shape of a spherical body part of the light emitting tube and the positional relation between the spherical body part and the light emission center are appositely defined to enhance the efficiency of use of a light flux emitted from the light emitting tube, in such a way as to make the light emitting tube highly suited for projectors of varied kinds.

To attain the above object, in accordance with one aspect of the invention, there is provided a light source apparatus, which comprises a spherical optical member formed with a transparent material and having an outer wall and an inner wall, and a light emitting part having a light emission center located within a space surrounded with the inner wall of the optical member, wherein the light emission center deviates from at least one of a center of the outer wall and a center of the inner wall, and the optical member is arranged to deflect in a predetermined direction a light flux emitted from the light emission center.

In accordance with another aspect of the invention, there is provided a light source apparatus, which comprises a spherical body part formed with a transparent material and having an outer wall and an inner wall, and a light emitting part having a light emission center located within a space surrounded with the inner wall of the spherical body part, wherein a light flux emitted from the light emitting part is radiated in a predetermined direction through the spherical body part, and the light source apparatus satisfies the following conditions:

$$D2<Rb$$

$$1.5\times D3<Ra$$

where Ra and Rb are radii of curvature of the outer wall and the inner wall of the spherical body part, respectively, D2 is a distance from the light emission center to the inner wall, and D3 is a radius of a bar-shaped part which holds the spherical body part.

The above and other objects and aspects of the invention will become apparent from the following detailed description of preferred embodiments thereof taken in conjunction with the accompanying drawings.

DETAILED DESCRIPTION OF THE INVENTION

Hereinafter, preferred embodiments of the invention will be described in detail with reference to the drawings.

Figure 1:
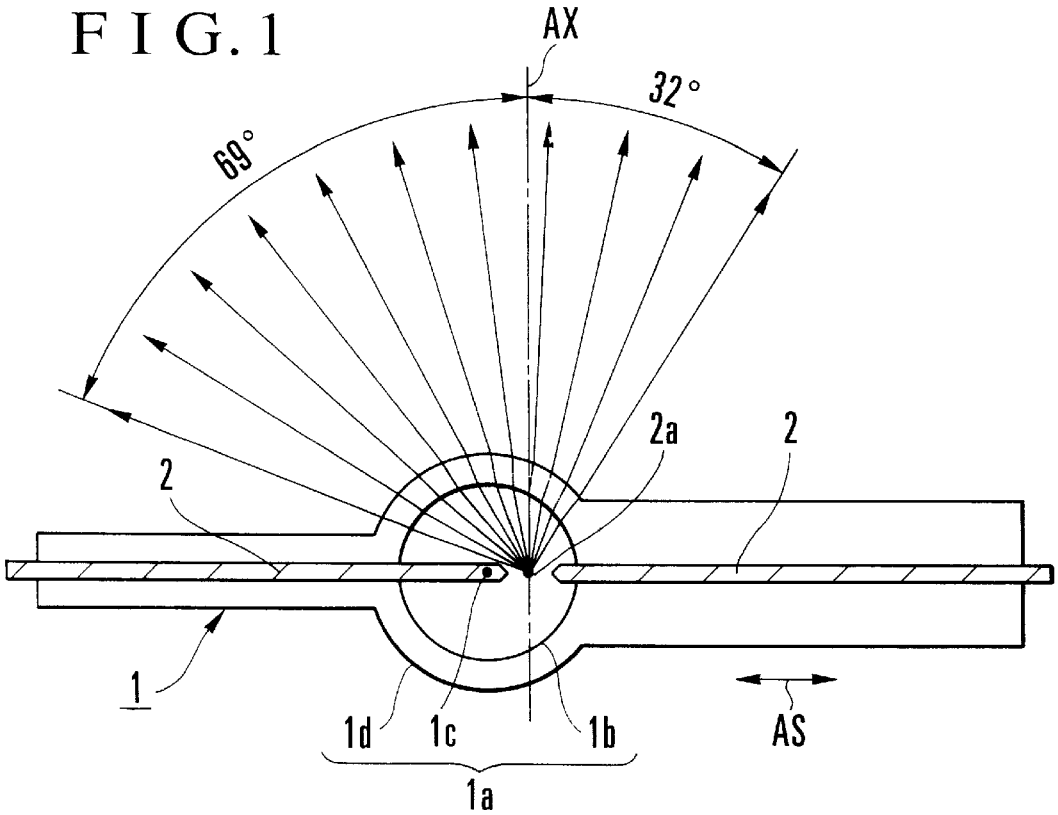
FIG. 1 is a schematic diagram showing essential parts of a light emitting tube according to a first embodiment of the invention.

FIG. 1 is a sectional view showing essential parts of a light emitting tube according to a first embodiment of the invention. In FIG. 1, reference numeral 1 denotes the light emitting tube. Two arc bars 2 are disposed in the light emitting tube 1. A middle point of a space (light emitting part) between the two arc bars 2 is a light emission center 2*a*. The light emitting tube 1 is provided with a spherical body part 1*a*. The spherical body part 1*a* has an outer wall 1*d* and an inner wall 1*b*. The light emission center 2*a* is made to deviate from the center 1*c* of the outer wall 1*d* of the spherical body part 1*a* in the longitudinal direction of the light emitting tube 1 indicated by an arrow AS (in the direction of alignment of the arc bars 2 and in the direction of the optical axis of an optical system if the light emitting tube 1 is used for an illumination apparatus). The center 1*c* of the outer wall 1*d* and the center of the inner wall 1*b* of the spherical body part 1*a* approximately coincide with each other. A known high-pressure gas is sealed inside of the inner wall 1*b* of the spherical body part 1*a* for emission of light.

Figure 6:
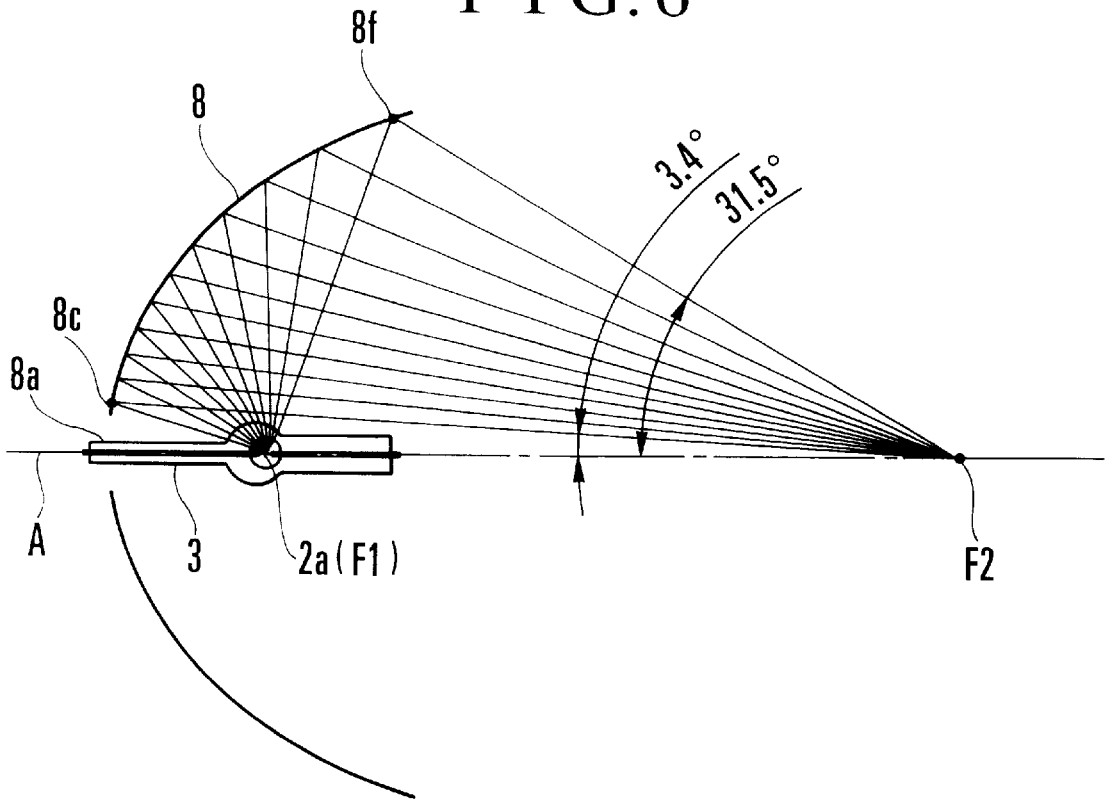
FIG. 6 is a schematic diagram showing essential parts of a light source apparatus according to a sixth embodiment of the invention.

With the first embodiment arranged as described above, there is obtained such a luminance intensity distribution that a light flux radiated from the light emitting tube 1 is biased with respect to the reference axis AX. As shown in FIG. 1, the angle of luminance intensity distribution with respect to the reference axis AX is 32° on one side and 69° on the other side. Further, although it is not shown in FIG. 1, a reflector is disposed on the left side of the light emitting tube 1, as shown in FIG. 6, to make the light flux effectively reach the reflector.

Further, it is sufficient that at least two of the center 1*c* of the outer wall 1*d* of the spherical body part 1*a*, the center of the inner wall 1*b* and the light emission center 2*a* deviate from each other, and such a combination of the two is arbitrarily selectable.

Figure 2:
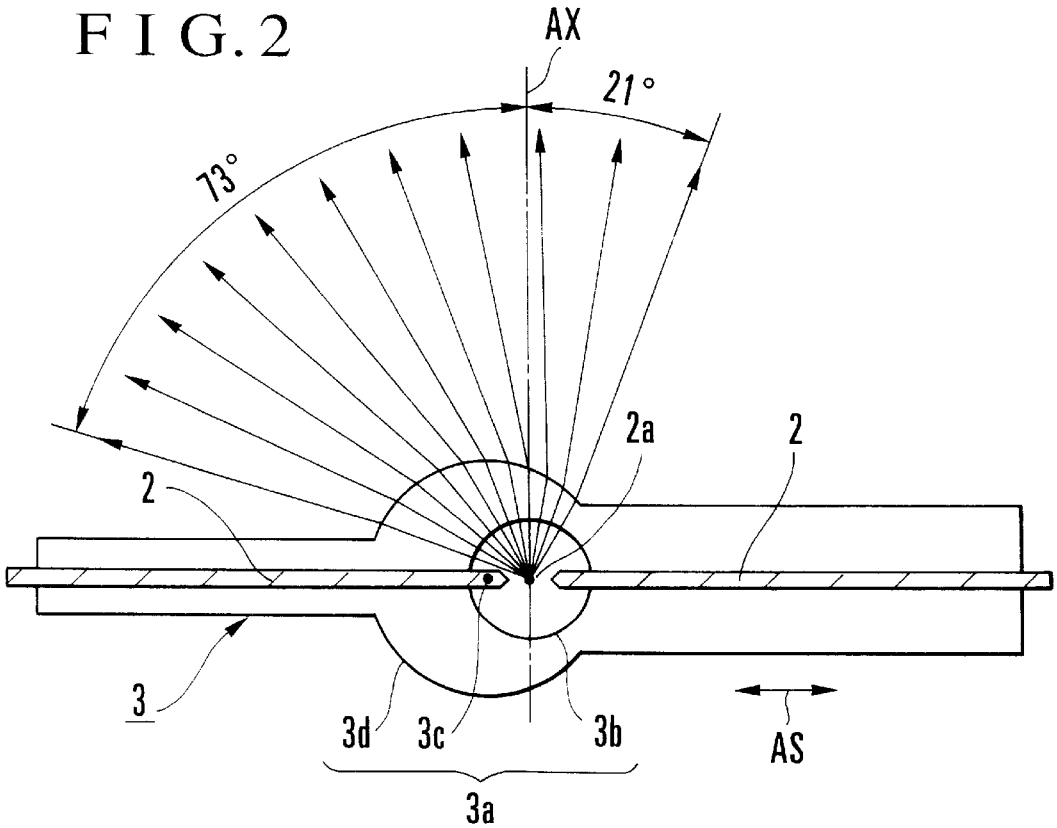
FIG. 2 is a schematic diagram showing essential parts of a light emitting tube according to a second embodiment of the invention.

FIG. 2 is a schematic diagram showing essential parts of a light emitting tube according to a second embodiment of the invention. In FIG. 2, reference numeral 3 denotes the light emitting tube. The light emitting tube 3 is provided with a spherical body part 3*a* having an outer wall 3*d* and an inner wall 3*b*. A middle point of a space between two arc bars 2, which are disposed in the light emitting tube 3, is a light emission center 2*a*. The light emission center 2*a* and the center of the inner wall 3*b* are disposed to deviate from the center 3*c* of the outer wall 3*d* of the spherical body part 3*a* in the longitudinal direction of the light emitting tube 3 indicated by a double-headed arrow AS. The light emission center 2*a* is located approximately at the center of the inner wall 3*b*.

With the light emission center 2*a* and the center of the inner wall 3*b* disposed to deviate from the center 3*c* of the outer wall 3*d* of the spherical body part 3*a*, the spherical light emitting tube 3 is given a light deflecting action, so that there is obtained such a luminance intensity distribution that a light flux radiated from the light emitting tube 3 is further biased.

Figure 3:
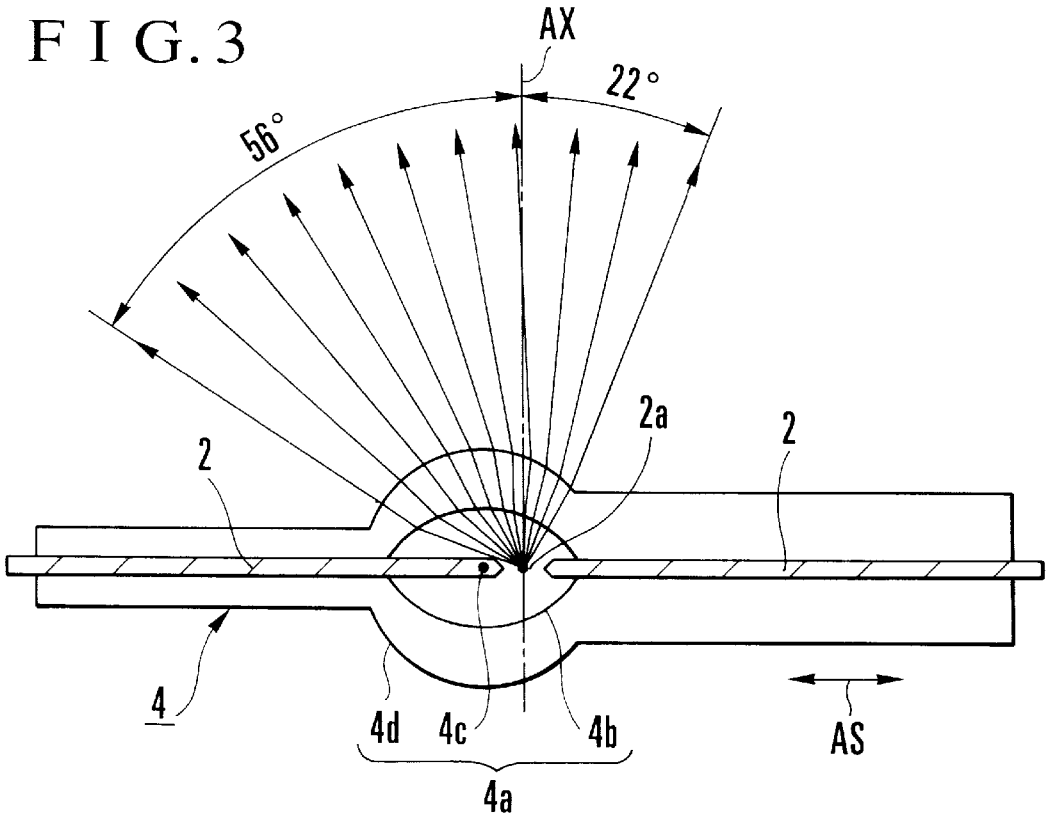
FIG. 3 is a schematic diagram showing essential parts of a light emitting tube according to a third embodiment of the invention.

FIG. 3 is a schematic diagram showing essential parts of a light emitting tube according to a third embodiment of the invention. In FIG. 3, reference numeral 4 denotes the light emitting tube. The light emitting tube 4 is provided with a spherical body part 4*a* having an outer wall 4*d* and an inner wall 4*b*. A middle point of a space between two arc bars 2, which are disposed in the light emitting tube 4, is a light emission center 2*a*. The light emission center 2*a* is disposed to deviate from the center 4*c* of the outer wall 4*d* of the spherical body part 4*a* in the longitudinal direction of the light emitting tube 4 indicated by a double-headed arrow AS.

Further, the radius of curvature of the inner wall 4*b*, as viewed in a sectional view of FIG. 3, is made larger than that of the inner wall 1*b* shown in FIG. 1 and is also made larger than that of the outer wall 4*d* of the spherical body part 4*a*, so that a member (spherical body part 4*a*) formed with the inner wall 4*b* and the outer wall 4*d* of the spherical body part 4*a* is given a larger light-condensing effect. Thus, a space in a Rugby-ball like shape is formed on the inner side of the inner wall 4*b* of the spherical body part 4*a*. In the light emitting tube 4, the light emission center 2*a* deviates from the center 4*c* of the outer wall 4*d* of the spherical body part 4*a* and the spherical body part 4*a* is given a light-condensing effect. By virtue of this arrangement, a light-condensing action on a light flux radiated from the light emitting part 2*a* is more enhanced, and there is obtained such a luminance intensity distribution that the light flux radiated from the light emitting part 2*a* is appropriately biased.

Incidentally, the center 4*c* of the outer wall 4*d* of the spherical body part 4*a* and the center of the inner wall 4*b* approximately coincide with each other. In the third embodiment, the angle of luminance intensity distribution with respect to the reference axis AX is 22° on one side and 56° on the other side.

Figure 4:
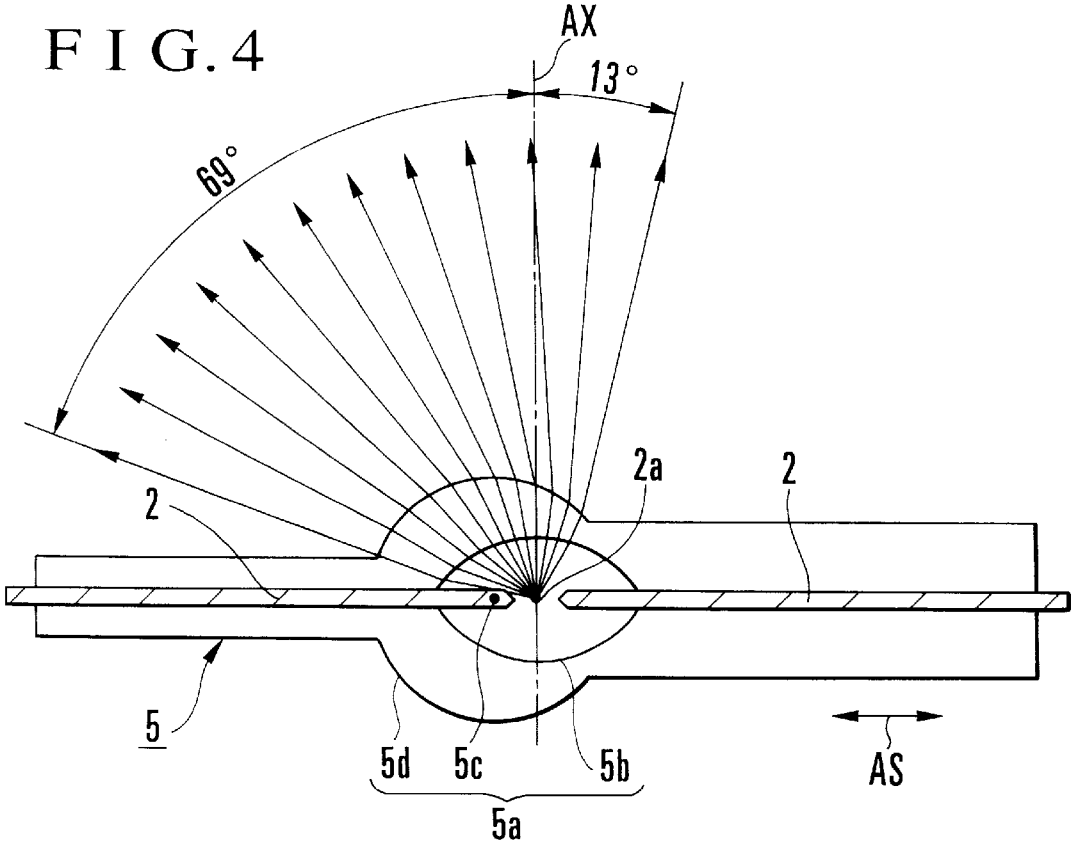
FIG. 4 is a schematic diagram showing essential parts of a light emitting tube according to a fourth embodiment of the invention.

FIG. 4 is a schematic diagram showing essential parts of a light emitting tube according to a fourth embodiment of the invention. In FIG. 4, reference numeral 5 denotes the light emitting tube. The light emitting tube 5 is provided with a spherical body part 5*a* having an outer wall 5*d* and an inner wall 5*b*. A middle point of a space between two arc bars 2, which are disposed in the light emitting tube 5, is a light emission center 2*a*. The light emission center 2*a* is disposed to deviate from the center 5*c* of the outer wall 5*d* of the spherical body part 5*a* in the longitudinal direction of the light emitting tube 5 indicated by a double-headed arrow AS. Further, the radius of curvature of the inner wall 5*b*, as viewed in a sectional view of FIG. 4, is made larger than that of the inner wall 1*b* of FIG. 1 and is also made larger than that of the outer wall 5*d* of the spherical body part 5*a*, so that the spherical body part 5*a* is given a large light-condensing effect, as in the third embodiment shown in FIG. 3. In addition, the center of the inner wall 5*b* deviates from the center 5*c* of the outer wall 5*d* of the spherical body part 5*a*.

In other words, a space in a Rugby-ball like shape is formed on the inner side of the inner wall 5*b* of the spherical body part 5*a* and in a position deviating from the center 5*c* of the outer wall 5*d* of the spherical body part 5*a*. The light emission center 2*a* is thus disposed to deviate from the center 5*c* of the outer wall 5*d* of the spherical body part 5*a*, and the spherical body part 5*a* is given a light-condensing effect. By virtue of this arrangement, a light-condensing action on a light flux radiated from the light emitting part 2*a* is more enhanced, and there is obtained such a luminance intensity distribution that the light flux radiated from the light emitting part 2*a* is more appropriately biased.

Incidentally, the center of the inner wall 5*b* and the light emission center 2*a* approximately coincide with each other. In the fourth embodiment, the angle of luminance intensity distribution with respect to the reference axis AX is 22° on one side and 56° on the other side.

Figure 5:
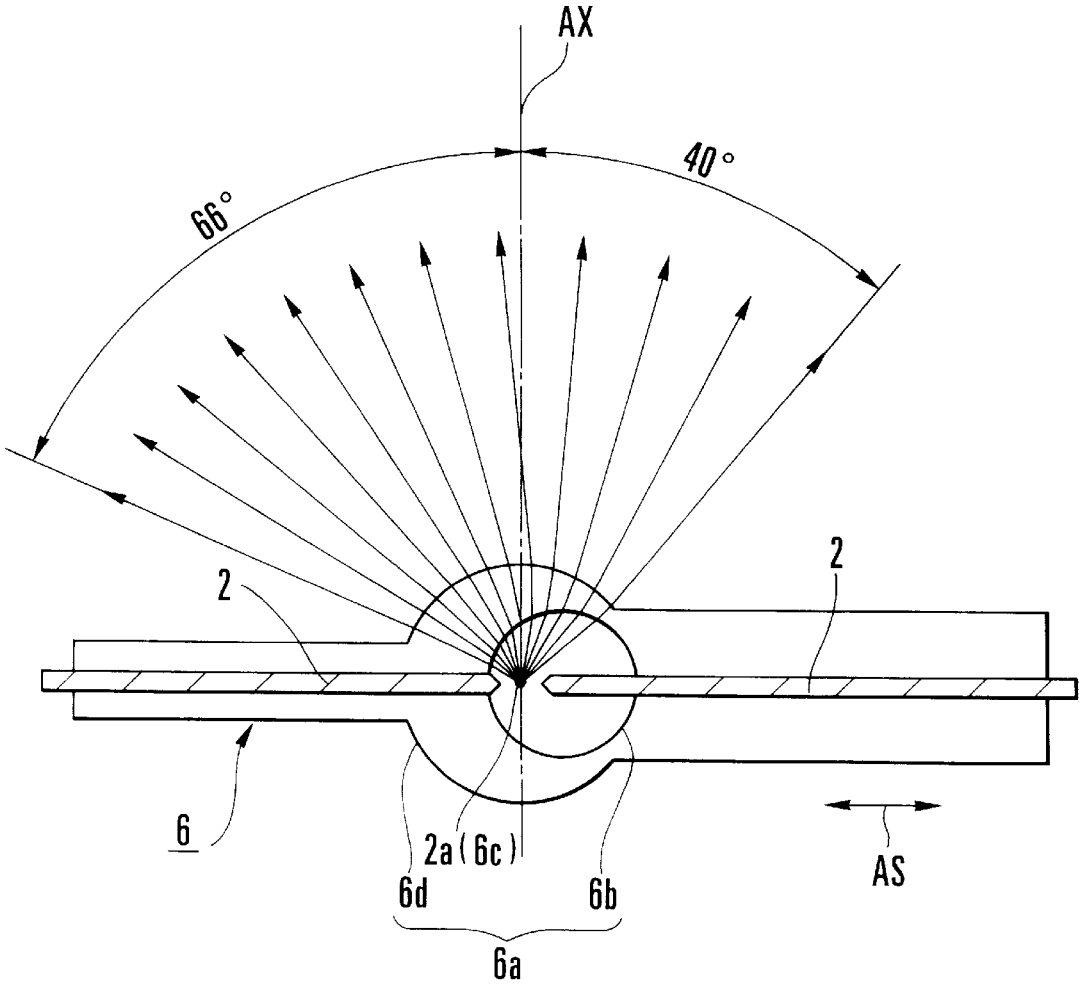
FIG. 5 is a schematic diagram showing essential parts of a light emitting tube according to a fifth embodiment of the invention.

FIG. 5 is a schematic diagram showing essential parts of a light emitting tube according to a fifth embodiment of the invention. In FIG. 5, reference numeral 6 denotes the light emitting tube. The light emitting tube 6 is provided with a spherical body part 6*a* having an outer wall 6*d* and an inner wall 6*b*. A middle point of a space between two arc bars 2, which are disposed in the light emitting tube 6, is a light emission center 2*a*. The light emission center 2*a* is disposed to coincide with the center 6*c* of the outer wall 6*d* of the spherical body part 6*a* of the light emitting tube 6. Further, the center of the inner wall 6*b* of the spherical body part 6*a* of the light emitting tube 6 is disposed to deviate from the center 6*c* of the outer wall 6*d* in the longitudinal direction of the light emitting tube 6 indicated by a double-headed arrow AS.

Thus, there is obtained such a luminance intensity distribution that a light flux radiated from the light emitting tube 6 is biased, by just deviating the inner wall 6*b* of the spherical body 6*a* of the light emitting tube 6. In the fifth embodiment, the angle of luminous intensity distribution with respect to the reference axis AX is 40° on one side and 66° on the other side.

FIG. 6 is a schematic diagram showing essential parts of a light source apparatus according to a sixth embodiment of the invention. In the case of the sixth embodiment, the light emitting tube 3 shown in FIG. 2 is applied to a part of a conventionally known ellipsoidal mirror 8. Referring to FIG. 6, the light emission center 2*a* of the light emitting tube 3 is located at a first focal point F1 of the ellipsoidal mirror 8 or in the neighborhood thereof. The axis of the light emitting tube 3 coincides with the optical axis of the light source apparatus. Reference numerals 8*f* and 8*c* denote respectively the outermost and innermost reflection parts of the ellipsoidal mirror 8. A light flux radiated from the light emission center 2*a* of the light emitting tube 3 is reflected by the reflection surface of the ellipsoidal mirror 8 and then converges at a second focal-point F2. The light flux having converged at the second focal point F2 then spreads to be incident on an optical system which constitutes, for example, an illumination apparatus. The light flux incident on the optical system is used for illuminating some surface to be illuminated. Assuming that the maximum diameter of the reflection surface of the ellipsoidal mirror 8 is approximately 80 mm, the first focal point F1 is located at a distance of 21 mm from an end face 8*a* of the ellipsoidal mirror 8 and the second focal point F2 is located at a distance of 109 mm from the end face 8*a*.

Figure 17:
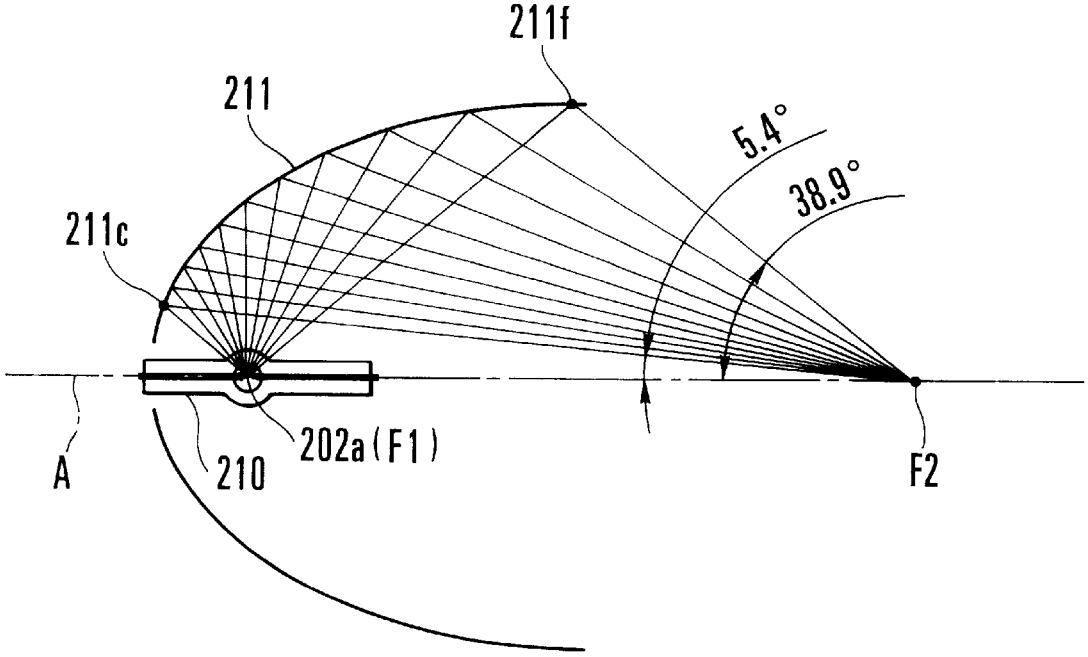
FIG. 17 is a schematic diagram showing essential parts of a light source apparatus using the conventional light emitting tube.

Compared with a light source apparatus using the conventional ellipsoidal mirror shown in FIG. 17, the arrangement of the sixth embodiment permits use of an ellipsoidal mirror having the first focal point F1 at a longer distance, so that the light-condensing efficiency can be enhanced.

Further, while the conventional ellipsoidal mirror shown in FIG. 17 has its first focal point F1 at a distance of 14 mm and its second focal point F2 at a distance of 109 mm, the arrangement of the sixth embodiment permits reduction of the paraxial magnifying rate of the ellipsoidal mirror to two thirds. As a result, the size of a secondary light source image formed at the second focal point F2 can be made smaller. Therefore, the efficiency of use of a light flux can be enhanced.

Figure 7:
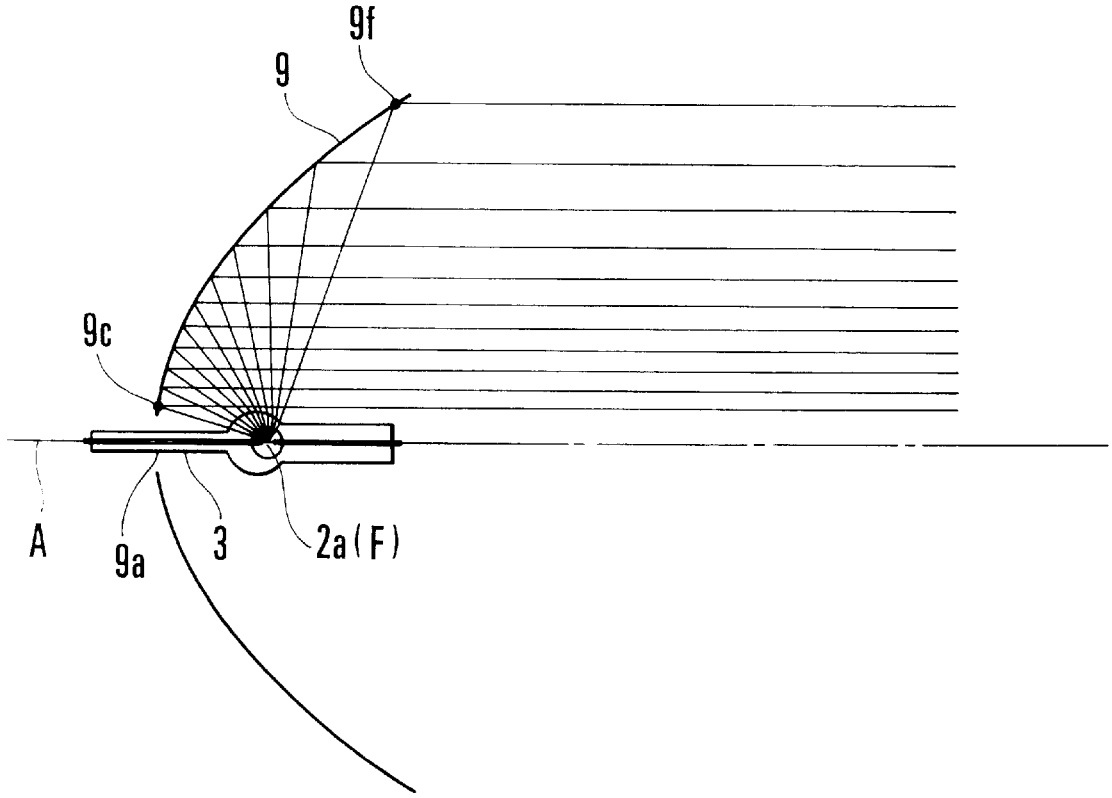
FIG. 7 is a schematic diagram showing essential parts of a light source apparatus according to a seventh embodiment of the invention.

FIG. 7 is a schematic diagram showing essential parts of a light source apparatus according to a seventh embodiment of the invention. In the case of the seventh embodiment, the light emitting tube 3 shown in FIG. 2 is applied to a part of a conventionally known paraboloidal mirror 9.

In the case of the seventh embodiment, the focal length of the paraboloidal mirror 9 is long. A light flux which is reflected by and exits from the paraboloidal mirror 9 is allowed to have a good degree of parallelism by virtue of the long focal length of the paraboloidal mirror 9. In FIG. 7, reference numerals 9*c* and 9*f* denote respectively the innermost and outermost reflection parts of the paraboloidal mirror 9. Assuming that the maximum diameter of the reflection surface of the paraboloidal mirror 9 is about 80 mm, the focal length F is 15 mm from an end face 9*a* of the paraboloidal mirror 9.

Figure 18:
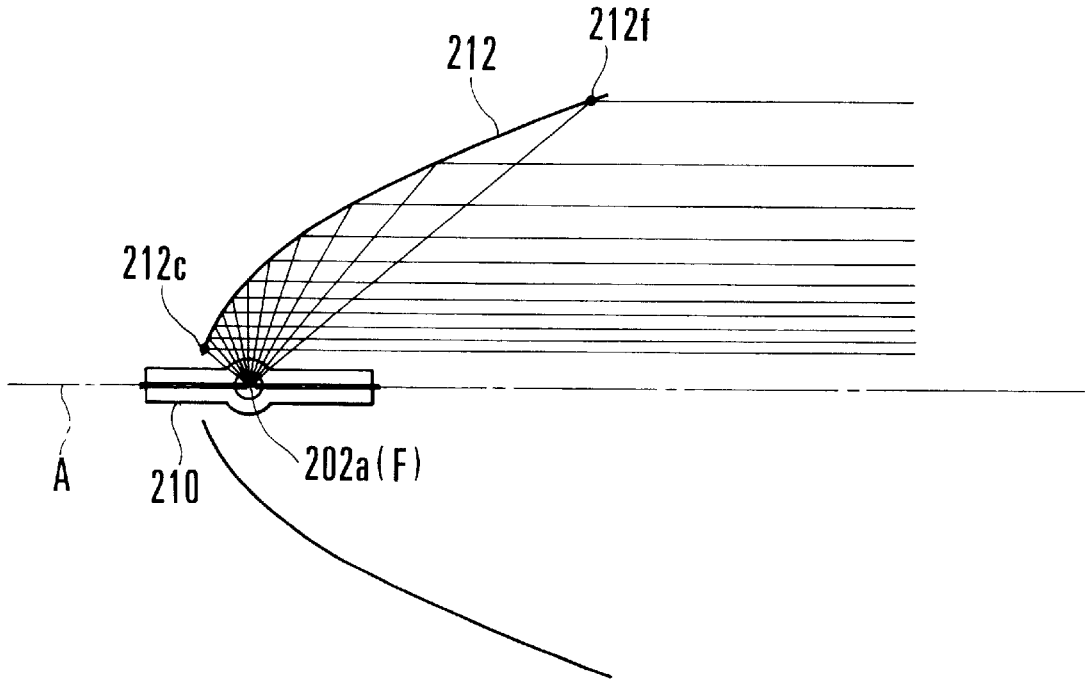
FIG. 18 is a schematic diagram showing essential parts of another light source apparatus using the conventional light emitting tube.

While the focal length F of the conventional paraboloidal mirror shown in FIG. 18 is 7.5 mm, the focal length F of the paraboloidal mirror can be doubled by the arrangement of the seventh embodiment. As a result, the degree of parallelism of the light reflected by the paraboloidal mirror can be reduced to one half.

Further, the reflection mirror used for the light source apparatus shown in FIG. 6 or FIG. 7 may have a spherical surface or an aspherical surface or may be an aggregation of minute flat surfaces forming a shape which resembles an ellipsoidal mirror or a paraboloidal mirror.

Figure 8:
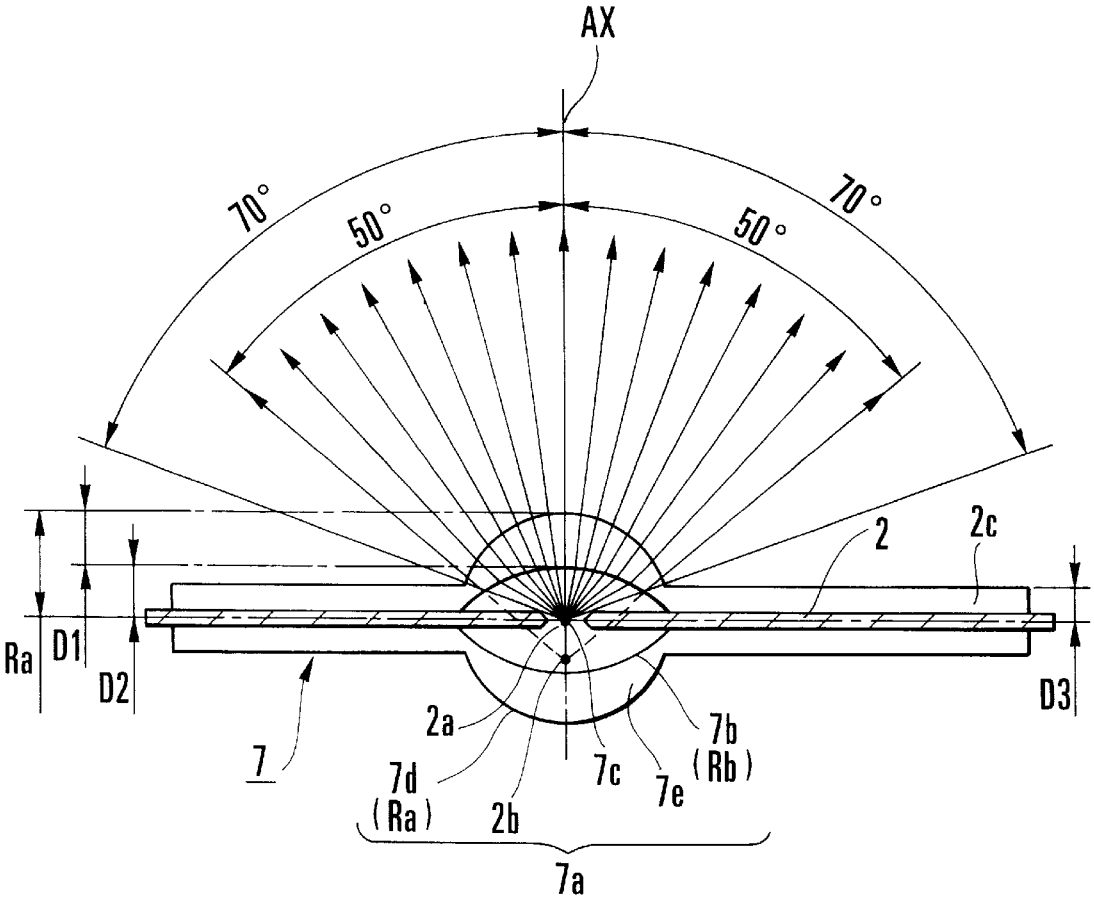
FIG. 8 is a schematic diagram showing essential parts of a light emitting tube according to an eighth embodiment of the invention.

FIG. 8 is a schematic diagram showing a light emitting tube according to an eighth embodiment of the invention. In FIG. 8, reference numeral 7 denotes the light emitting tube. Two arc bars 2 are disposed in the light emitting tube 7. Light emission is made by a space between the two arc bars 2. A middle point of the space between the two arc bars 2 is a light emission center 2*a* of the light emitting tube 7.

The light emitting tube 7 is provided with a spherical body part 7*a* having an outer wall 7*d* and an inner wall 7*b*. The center 7*c* of the outer wall 7*d* coincides approximately with the light emission center 2*a*. The radius of curvature of the outer surface (outer wall) 7*d* and that of the inner surface (inner wall) 7*b* are set in such a way as to let an optical member (glass body) 7*e* formed with the both surfaces 7*d* and 7*b* perform a light-condensing action on a light flux radiated from the light emission center 2*a*.

A practicable shape of the light emitting tube 7 according to the eighth embodiment is next described as follows. FIG. 8 represents a case where the radius of curvature Ra of the outer wall 7*d* of the spherical body part 7*a* is 4 mm, the radius of curvature Rb of the inner wall 7*b* is 6 mm, the glass thickness D1 of the optical member 7*e* is 2 mm, a distance D2 between the inner wall 7*b* of the spherical body part 7*a* and the center 7*c* of the outer wall 7*d* of the spherical body part 7*a* is 2 mm, the refractive index of the glass material of the light emitting tube 7 is 1.5, a spacing distance between the two arc bars 2 is 1.4 mm, and the radius D3 of a bar-shaped part 2*c* is 1.25 mm.

The center 7*c* of the outer wall 7*d* of the spherical body part 7*a* coincides with the light emission center 2*a*. The radius of curvature Rb of the inner wall 7*b* is made larger than the distance D2 between the center 7*c* of the outer wall 7*d* of the spherical body part 7*a* and the inner wall 7*b*, so that the glass body (optical member) 7*e* of the spherical body part 7*a* of the light emitting tube 7 is given a light-condensing effect. A space of a Rugby-ball-like shape is formed inside of the inner wall 7*b* of the spherical body part 7*a*. With the light emitting tube 7 shaped as described above and as shown in FIG. 8, a light flux emitted at an angle of 70° from the light emission center 2*a* of the light emitting tube 7 is condensed to a radiation angle of 50°.

In the case of the light emitting tube 7 according to the eighth embodiment as described above, the light emitted from the light emission center 2*a* almost completely converges within an angle of 50°. In this instance, an apparent light emission center of the light emitting tube 7 shifts to a point 2*b*. A virtual image of the light emission center 2*a* is thus formed at the point 2*b*.

In the case of the eighth embodiment, the following conditions are satisfied:

$$D2<Rb \quad (1)$$

$$1.5\times D3<Ra \quad (2)$$

where Ra is a radius of curvature of the outer wall 7*d* of the spherical body part 7*a* of the light emitting tube 7, Rb is a radius of curvature of the inner wall 7*b* of the spherical body part 7*a* of the light emitting tube 7, D2 is a distance from the light emission center 2*a* to the apex of the inner wall 7*b*, and D3 is a radius of the bar-shaped part 2*c* of the light emitting tube 7.

The conditional formula (1) above is given for limiting a relation between the radius of curvature Rb of the inner wall 7*b* of the spherical body part 7*a* of the light emitting tube 7 and the distance D2 from the light emission center 2*a* to the inner wall 7*b* of the spherical body part 7*a*. The light-condensing effect of the spherical body part 7*a* is not sufficient outside of the limit imposed by the conditional formula (1).

The conditional formula (2) limits a relation between the radius of curvature Ra of the outer wall 7*d* of the spherical body part 7*a* of the light emitting tube 7 and the radius D3 of the bar-shaped part 2*c*. The quantity of light incident on the bar-shaped part 2*c* increases outside of the limit imposed by the conditional formula (2). The increase in the quantity of light incident on the bar-shaped part 2*c* lowers the illumination efficiency and is, therefore, not desirable.

Further, the conditional formulas (1) and (2) are preferably set as expressed below:

$$1.5\times D2<Rb \quad (1a)$$

$$2\times D3<Ra \quad (2a)$$

In the eighth embodiment, the light emitting tube 7 may be one of light emitting tubes according to the above-described first to fifth embodiments, in which at least two of the center of the outer wall of the spherical body part, the center of the inner wall of the spherical body part and the light emission center deviate from each other. Such an arrangement further enhances the efficiency of use of the light flux radiated from the light emission tube 7.

Figure 9:
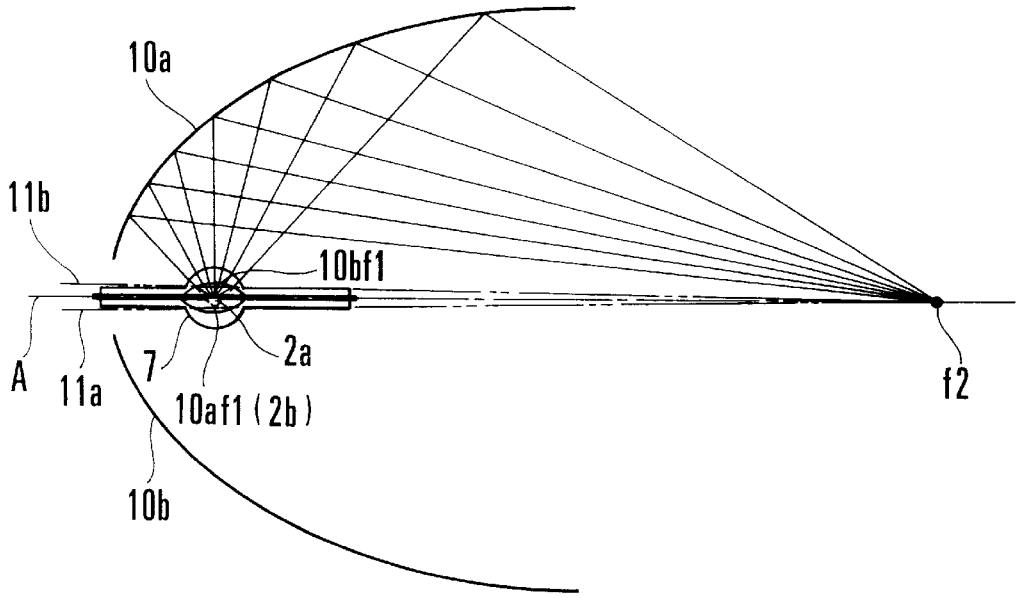
FIG. 9 is a schematic diagram showing essential parts of a light source apparatus according to a ninth embodiment of the invention.

FIG. 9 is a schematic diagram showing essential parts of a light source apparatus according to a ninth embodiment of the invention. In the case of the ninth embodiment, the light emitting tube 7 shown in FIG. 8 is incorporated into a rotary reflecting mirror which is in an elliptic sectional shape.

Referring to FIG. 9, the optical axis 11*a* of an ellipse 10*a* is disposed to be inclined counterclockwise with respect to the rotation axis A of the rotary reflecting mirror around the second focal point f2 of the ellipse 10*a* which is located on the rotation axis A of the rotary reflecting mirror.

The optical axis 11*b* of another ellipse 10*b* is, on the other hand, disposed to be inclined clockwise with respect to the rotation axis A of the rotary reflecting mirror around the second focal point f2 of the ellipse 10*b* which is located on the rotation axis A of the rotary reflecting mirror.

With the ellipse 10*a* thus disposed to be inclined with respect to the rotation axis A of the rotary reflecting mirror, a virtual image 2*b* of the light emission center 2*a* of the light emitting tube 7 is made to coincide with the first focal point 10*a*f1 of the ellipse 10*a*. By virtue of this arrangement, the light radiated from the light emitting tube 7 is efficiently converged at the second focal point f2 of the ellipse 10*a*.

The rotary reflecting mirror according to the ninth embodiment is thus arranged to be an elliptic rotating body in which the optical axis 11*a* of the ellipse 10*a* is inclined with respect to the rotation axis A of the rotary reflecting mirror.

Figure 10:
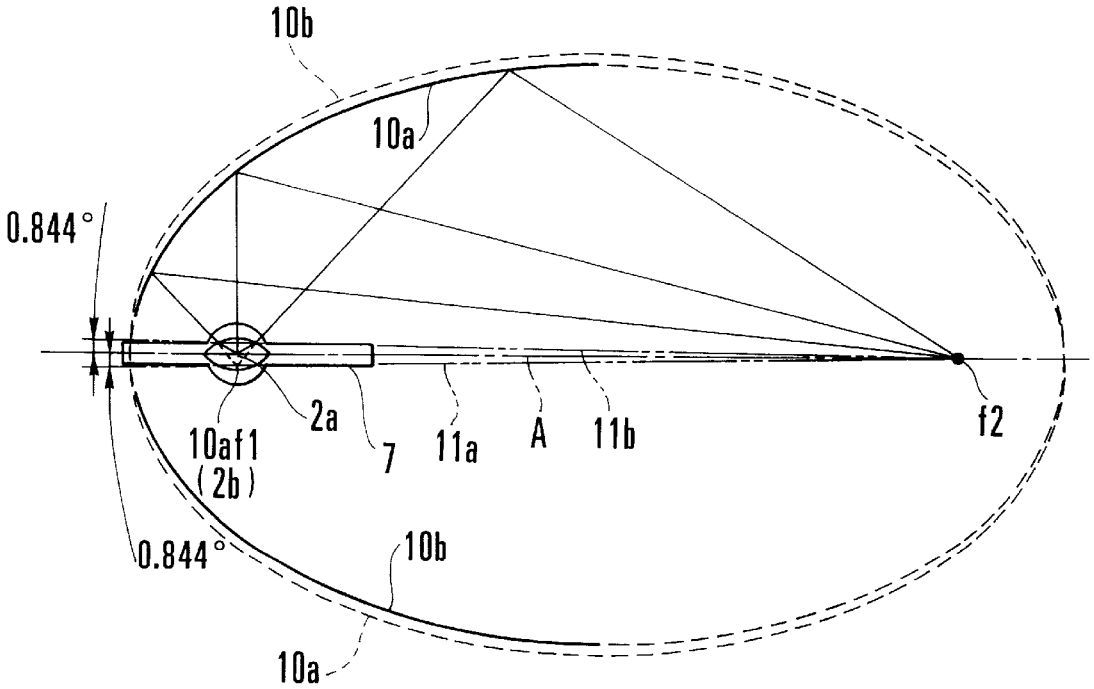
FIG. 10 is a detail view of the light source apparatus shown in FIG. 9.

FIG. 10 is a sectional view showing more clearly the relative locations of the ellipses 10*a* and 10*b* and the light emitting tube 7. As shown in FIG. 10, the ellipse 10*a* is inclined, around the second focal point f2 of the ellipse 10*a* which is located on the rotation axis A of the rotary reflecting mirror, 0.844° counterclockwise with respect to the rotation axis A in such a way as to have the virtual image position 2*b* of the light emission center 2*a* of the light emitting tube 7 coincide with the first focal point f1 of the ellipse 10*a*. The ellipse 10*b* is inclined, around the second focal point f2 of the ellipse 10*b* which is located on the rotation axis A of the rotary reflecting mirror, 0.844° clockwise with respect to the rotation axis A of the rotary reflecting mirror.

Figure 11:
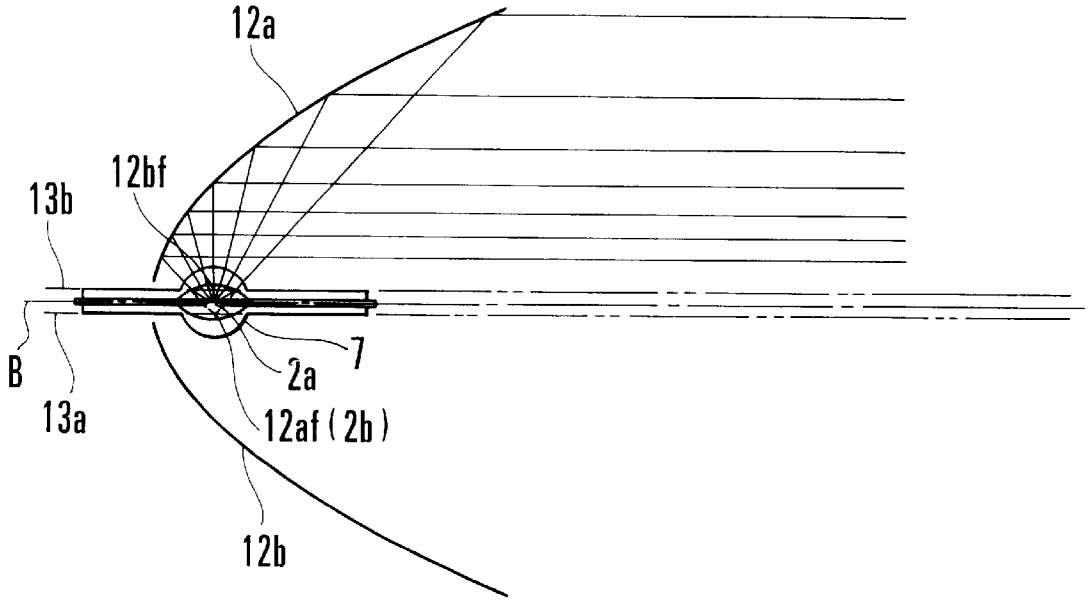
FIG. 11 is a schematic diagram showing essential parts of a light source apparatus according to a tenth embodiment of the invention.

FIG. 11 is a schematic diagram showing essential parts of a light source apparatus according to a tenth embodiment of the invention. In the case of the tenth embodiment, the light emitting tube 7 shown in FIG. 8 is incorporated into a rotary reflecting mirror which is in a parabolic sectional shape.

The rotary reflecting mirror according to the tenth embodiment is in a shape obtained by moving the optical axis 13*a* of a paraboloidal mirror 12*a* in parallel with the rotation axis B of the rotary reflecting mirror and rotating the paraboloidal mirror 12*a* with respect to the rotation axis B of the rotary reflecting mirror. With the rotary reflecting mirror in the above shape, a virtual image 2*b* of the light emission center 2*a* of the light emitting tube 7 is made to coincide with the focal point 12*af* of the paraboloidal mirror 12*a*. In the case of a paraboloid, the second focal point of a conic curve is located at an infinity distance position. Therefore, the optical axis of the paraboloid comes to be in parallel to the rotation axis of the rotary reflecting mirror only in this case.

Figure 12:
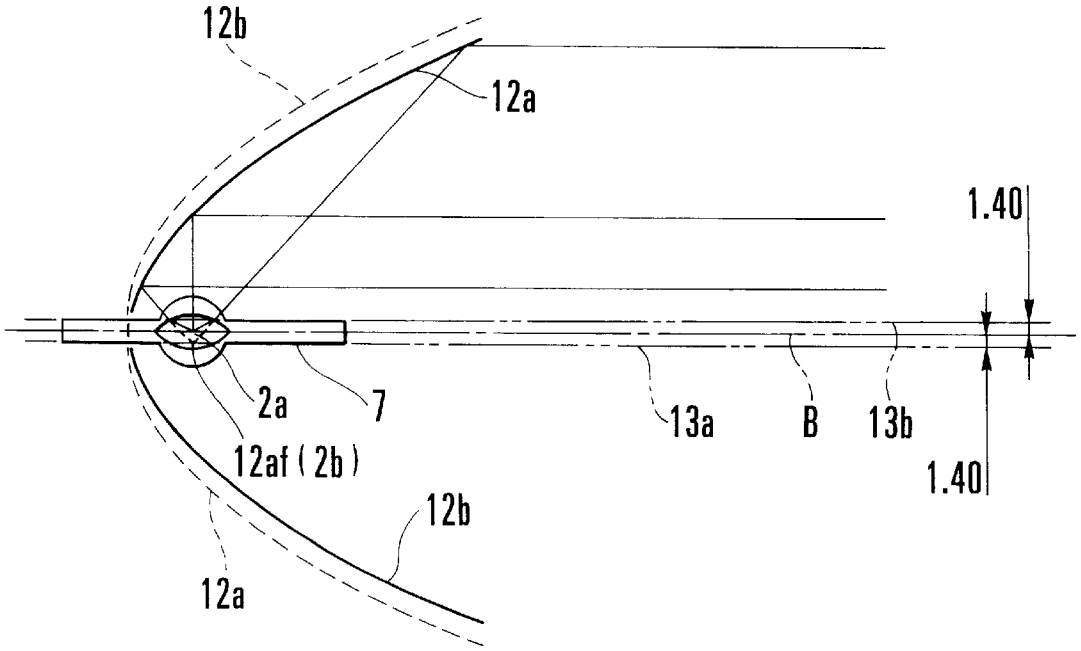
FIG. 12 is a detail view of the light source apparatus shown in FIG. 11.

FIG. 12 is a sectional view showing more clearly the positions of paraboloidal mirrors 12*a* and 12*b* in relation to the light emitting tube 7 shown in FIG. 11. The virtual image position 2*b* of the light emission center 2*a* of the light emitting tube 7 is made to coincide with the focal point 12*af* of the paraboloidal mirror 12*a* by shifting the optical axis 13*a* of the paraboloidal mirror 12*a* in parallel with the rotation axis B of the rotary reflection mirror 1.4 mm downward as viewed in FIG. 12. Further, the optical axis 13*b* of the paraboloidal mirror 12*b* is shifted in parallel with the rotation axis B of the rotary reflecting mirror 1.4 mm upward as viewed in FIG. 12.

The reflection surface which constitutes the rotary reflecting mirror may be an aggregation of minute flat mirrors formed in a shape resembling an ellipse or a parabola.

Figure 13:
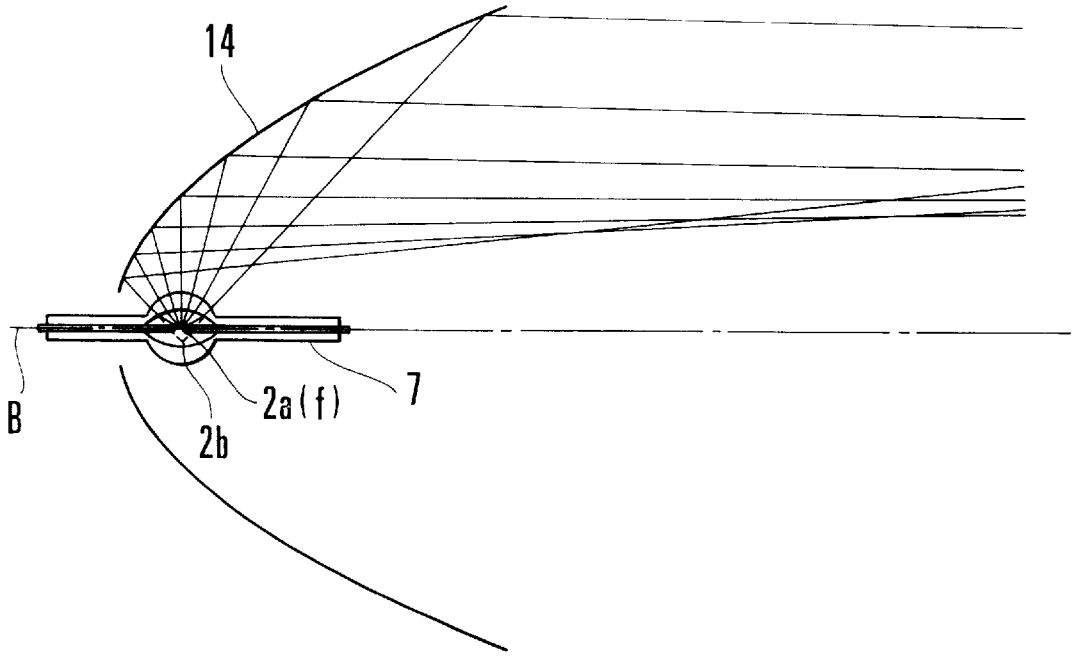
FIG. 13 is a diagram for explaining a case where the light emitting tube according to the eighth embodiment is applied to a conventional paraboloidal mirror.

FIG. 13 is a sectional view of a light source apparatus formed by incorporating the light emitting tube 7 shown in FIG. 8 into a conventional paraboloidal mirror 14. In this case, the virtual image 2*b* of the light emission center 2*a* of the light emitting tube 7 does not coincide with the focal point f of the paraboloidal mirror 14. Therefore, light reflected by the paraboloidal mirror 14 and exiting therefrom has an insufficient degree of parallelism.

Figure 14:
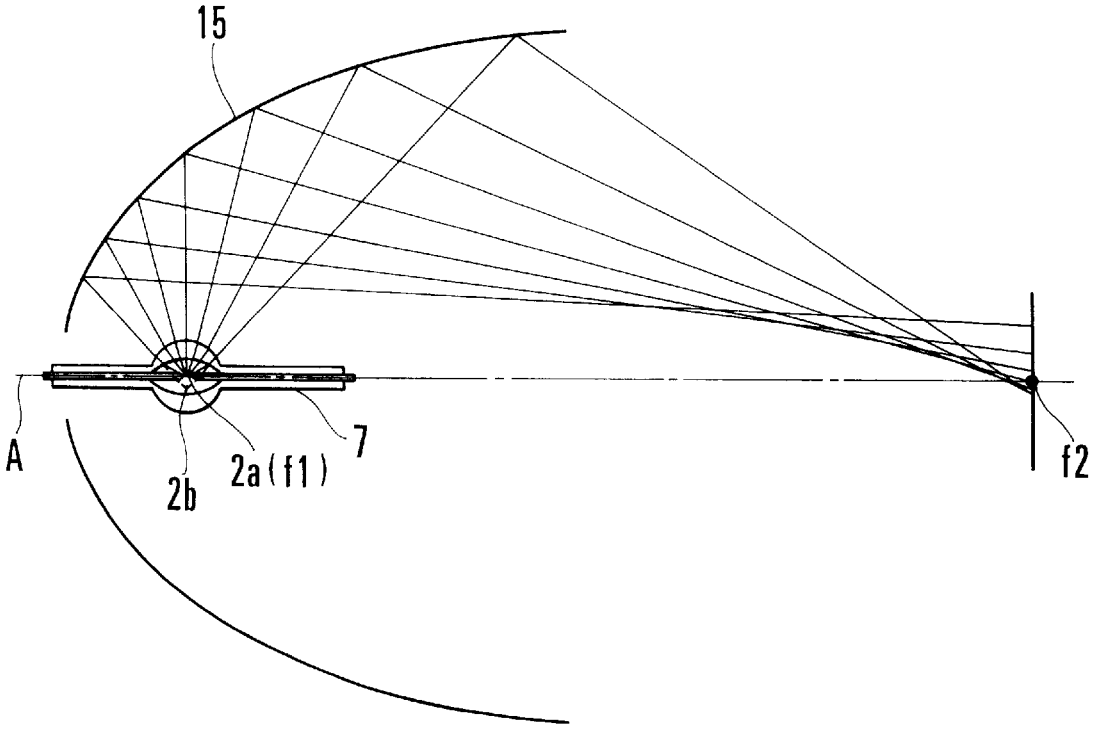
FIG. 14 is a diagram for explaining a case where the light emitting tube according to the eighth embodiment is applied to a conventional ellipsoidal mirror.

FIG. 14 is a sectional view of a light source apparatus formed by incorporating the light emitting tube 7 shown in FIG. 8 into a conventional ellipsoidal mirror 15. In this case, the virtual image 2*b* of the light emission center 2*a* of the light emitting tube 7 also does not coincide with the first focal point f1 of the ellipsoidal mirror 15. Therefore, a light source image formed at the second focal point f2 of the ellipsoidal mirror 15 spreads to give an inadequate light-condensing effect.

In the case of FIG. 9 or 11, the light emitting tube 7 may be one of light emitting tubes according to the above-described first to fifth embodiments, in which at least two of the center of the outer wall of the spherical body part, the center of the inner wall of the spherical body part and the light emission center deviate from each other. Such an arrangement further enhances the efficiency of use of the light flux radiated from the light emission tube 7.

Figure 15:
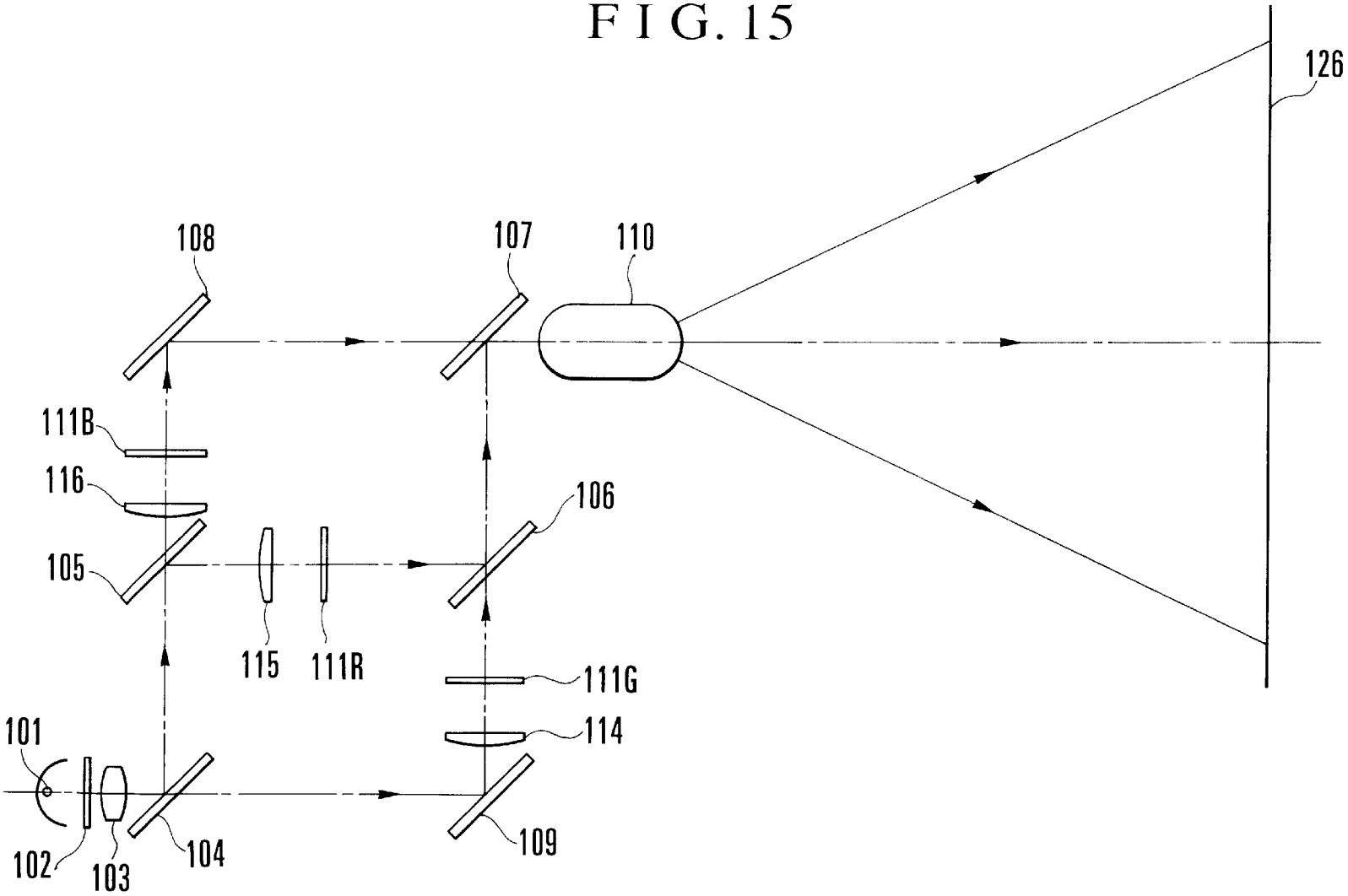
FIG. 15 is a schematic diagram showing essential parts of a liquid crystal projector using a light source apparatus according to the invention.
Figure 16:
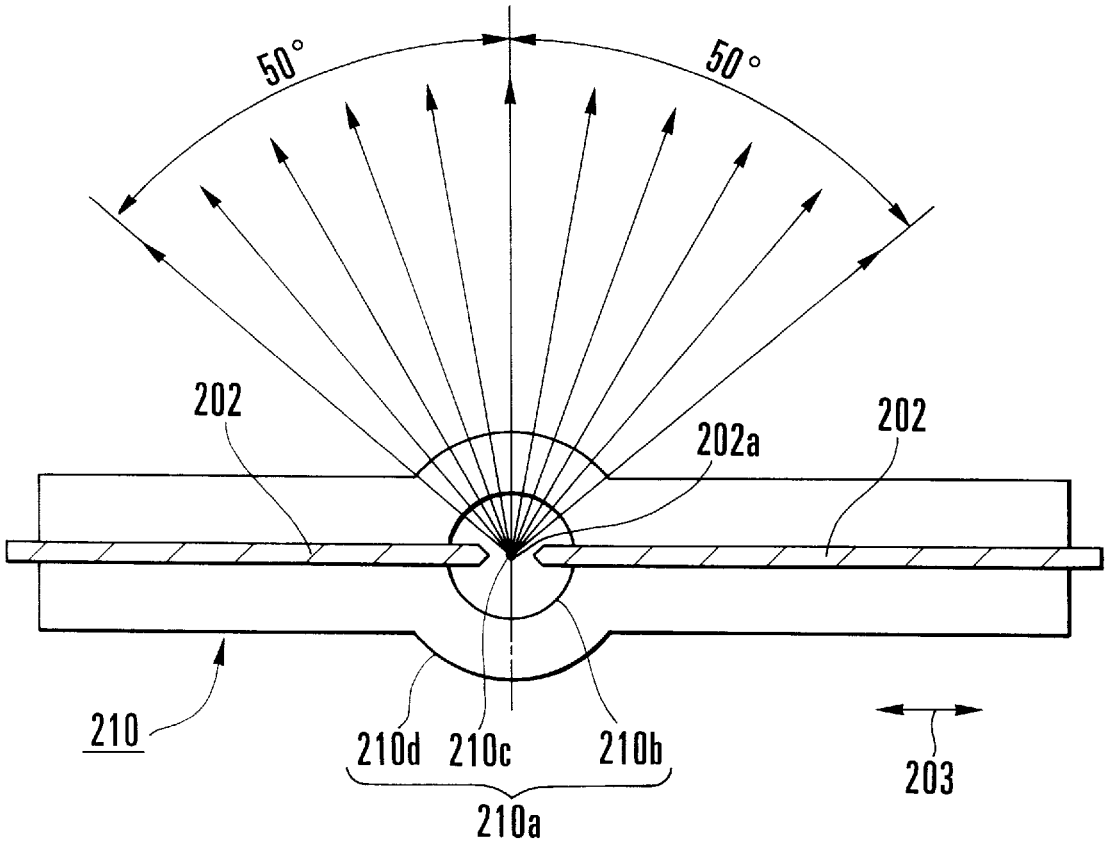
FIG. 16 is a schematic diagram showing essential parts of a conventional light emitting tube.

FIG. 15 is a schematic diagram showing a liquid crystal projector using a light source apparatus arranged according to the invention. Referring to FIG. 15, reference numeral 101 denotes the light source apparatus. A light flux (white light) from the light source apparatus 101 is made incident on a dichroic mirror 104 after it is condensed by a condenser lens 103 through an infrared cut filter 102. The dichroic mirror 104 then acts to color-separate the incident light in such a manner that a first color light component, which is G (green) for example, is allowed to pass therethrough and second and third color light components, which are R and B (red and blue) for example, are reflected therefrom.

The dichroic mirror 105 acts to reflect the second color light component (R) and to pass the third color light component (B). The color light components R and B thus obtained respectively pass through condenser lenses 115 and 116 to illuminate liquid crystal panels 111R and 111B which are arranged to display monochromatic images in corresponding colors.

The first color light component which has passed through the dichroic mirror 104 is, on the other hand, reflected by a total reflection mirror 109 and comes to illuminate a liquid crystal panel 111G through a condenser lens 114. The color light components R and G coming from the liquid crystal panels 111R and 111G are color-combined by a dichroic mirror 106. The combined color light thus obtained advances to a dichroic mirror 107 to be combined further with the color light component B which comes from the liquid crystal panel 111B through a total reflection mirror 108.

The combined color components R, G and B thus obtained are led to a screen surface 126 by a projection lens 110. Thus, image information pieces obtained on the liquid crystal panels 111R, 111G and 111B are superimposed on each other and projected on the screen 126 in an enlarged state.

According to the invention, as described in the foregoing, a light emitting tube and a light source apparatus using the same can be arranged to be highly suited for projectors of varied kinds, in such a way as to increase the efficiency of use of a light flux emitted from the light emitting tube, by appositely setting the shape of the spherical body part of the light emitting tube and the positional relation between the spherical body part and the light emission center.

Particularly, according to the invention, the light emission center is disposed to deviate from the center of the outer wall of the spherical body part of the light emitting tube, or the spherical body part of the light emitting tube produces such a light intensity distribution that a light flux radiated from the light emitting tube is biased. By virtue of this arrangement, the efficiency of use of light can be enhanced by combining the light emitting tube with an ellipsoidal mirror which has a small magnifying rate or a paraboloidal mirror which has a long focal length.

Further, according to the invention, the spherical body part of the light emitting tube is made to have a light-condensing effect, and the optical axis of a conical curve forming a sectional shape of a rotary reflecting mirror is rotated with respect to the rotation axis of the rotary reflecting mirror around the second focal point of the conical curve located on the rotation axis of the rotary reflecting mirror, in such a way as to make the virtual image of the light emission center of the light emitting tube coincide with the first focal point of the rotary reflecting mirror. By virtue of this arrangement, light emitted from the light emitting tube can be caused to almost completely converge at the second focal point to further enhance the efficiency of use of the light.

What is claimed is:

1. A light source apparatus comprising:

a spherical body part formed with a transparent material and having an outer wall and an inner wall; and a light emitting part having a light emission center located within a space surrounded with the inner wall of said spherical body part, wherein a light flux emitted from said light emitting part is radiated in a predetermined direction through said spherical body part, and said light source apparatus satisfies the following conditions:

$$D2<Rb$$

$$1.5\times D3<Ra$$

where Ra and Rb are radii of curvature of the outer wall and the inner wall of said spherical body part, respectively, D2 is a distance from the light emission center to the inner wall, and D3 is a radius of a bar-shaped part which holds said spherical body part.

2. An apparatus according to claim 1, wherein at least two of a center of the outer wall of said spherical body part, a center of the inner wall of said spherical body part and the light emission center of said light emitting part are disposed to deviate from each other.

3. An apparatus according to claim 1, further comprising a reflecting mirror arranged to reflect a light flux radiated from said spherical body part to be led in a predetermined direction.

4. An apparatus according to claim 1, further comprising a rotary reflecting mirror having a reflection surface which is rotationally symmetric and which is arranged to reflect a light flux radiated from said spherical body part to be led in a predetermined direction.

5. A light source apparatus comprising a light emission tube having a hollowed portion, with an inner wall defining the hollowed portion and an outer wall of the hollowed portion having a curved surface respectively, and with a center of light emission being located in the hollowed portion, wherein a center of the curved surface of the outer wall and a center of the curved surface of the inner wall are deviated from each other relative to a cross-sectional plane including an axis penetrating a solid bar portion of the light emission tube.

6. A light source apparatus according to claim 5, further comprising a pair of arc rods separated with a predetermined space, with the center of light emission being located within the space.

7. A light source apparatus according to claim 5, further comprising a concave mirror, wherein the light emission tube has such a light amount distribution that the light amount is larger on one side of a plane passing the center of the light emission and vertically crossing the axis penetrating the solid bar portion than on the other side of the plane, and the concave mirror is located on the one side of the plane having the larger light amount.

8. A light emission apparatus according to claim 7, further comprising a reflection surface of rotation symmetry relative to the axis penetrating the solid bar portion, which reflects a light flux emitted from the light emission tube and guides the light flux in a predetermined direction.

9. A light emission apparatus according to claim 5, wherein the radius of curvature of the curved surface of the inner wall is larger than that of the outer wall.

10. A light emission apparatus, comprising:

a light emission tube having a hollowed portion, with an inner wall defining the hollowed portion and an outer wall of the hollowed portion having a curved surface respectively, and with a center of light emission being located in the hollowed portion and satisfying the conditions of D2<Rb, and 1.5 D3<Ra, wherein Ra and Rb are respectively a radius of curvature of the curved surface of the outer wall and a radius of curvature of the curved surface of the outer wall relative to a cross-section plane including an axis penetrating a solid bar portion of the light emission tube, D2 is a distance from the center of light emission to the inner wall relative to the cross-sectional plane, and D3 is a radius of the solid bar portion relative to the cross-sectional plane.

11. A light emission apparatus according to claim 10, further comprising a pair of arc bars separated with a predetermined space, with the center of light emission being located within the space.

12. A light emission according to claim 11, further comprising a concave mirror, wherein the light emission tube has such a light amount distribution that the light amount is larger on one side of a plane passing the center of the light emission and vertically crossing the axis penetrating the solid bar portion than on the other side of the plane, and the concave mirror is located on the one side of the plane having the larger light amount.

13. A light source apparatus according to claim 12, wherein at least two centers of the center of the curved surface of the outer wall of the hollowed portion and the center of the curved surface of the inner wall defining the hollowed portion and the center of the light emission are deviated from each other in a direction of the axis.

14. A light emission apparatus according to claim 13, further comprising a reflection surface of rotation symmetry relative to the axis penetrating the solid bar portion, which reflects a light flux emitted from the light emission tube and guides the light flux in a predetermined direction.

15. A light emission apparatus according to claim 10, wherein the radius of curvature of the curved surface of the inner wall is larger than that of the outer wall.

16. A light emission apparatus according to claim 13, wherein the curved surface of the outer wall is spherical.

17. A light emission apparatus according to claim 10, wherein the curved surface of the inner wall is a spherical surface.

18. A light emission apparatus, comprising:

a light emission tube having a hollowed portion, with a center of light emission being located in the hollowed portion, the light emission tube having two solid bar portions on an axis penetrating the hollowing portion, wherein the light emission tube has two parts divided by a plane passing the center of the light emission and vertically crossing the axis penetrating the hollowed portion and has such a light amount distribution that one of the two divided parts has a larger light amount than the other part and one of the two solid bar portions on one side of the plane having the larger light amount is thinner than the other of the solid bar portions on the other side of the plane.

19. A light emission apparatus according to claim 18, further comprising a pair of arc bars separated with a predetermined space, with the center of light emission being located within the space.

20. A light emission apparatus according to claim 18, further comprising a concave mirror of rotation symmetry relative to the axis located on the part having a larger amount of light.

21. A light emission apparatus according to claim 18, wherein the inner and outer walls of the hollowed portion have a curved surface respectively and the radius of curvature of the curved surface of the inner wall is larger than that of the outer wall on a cross-sectional plane including the axis of penetrating the solid bar.

22. A light emission apparatus according to claim 18, wherein the outer wall of the hollowed portion and the inner wall defining the hollowed portion have a curved surface respectively, and the conditions of $D2<Rb$, and $1.5 \cdot D3<Ra$ are satisfied, in which Ra and Rb are radius of curvature of the curved surfaces of the inner and outer walls, D2 is a distance from the center of light emission to the inner wall, and D3 is a radius of the other of the solid bar parts having a larger thickness.

23. An image projection apparatus comprising:

a light emission apparatus according to any of claims 1–22;

an image forming element for forming an image; and an illumination optical system which introduces light from the light emission apparatus to the image forming apparatus, and a projection optical system which projects the light from the image forming element onto an objective surface.

* * * * *

UNITED STATES PATENT AND TRADEMARK OFFICE

CERTIFICATE OF CORRECTION

PATENT NO. : 6,246,170 B1
DATED : June 12, 2001
INVENTOR(S) : Saburo Sugawara

It is certified that error appears in the above-identified patent and that said Letters Patent is hereby corrected as shown below:

Column 6,
Line 28, "focal-point" should read -- focal point --.

Signed and Sealed this

Thirtieth Day of April, 2002

*Attest:*

*Attesting Officer*

JAMES E. ROGAN
*Director of the United States Patent and Trademark Office*